United States Patent [19]

Budzich

[11] 4,153,075

[45] May 8, 1979

[54] LOAD RESPONSIVE CONTROL VALVE

[76] Inventor: Tadeusz Budzich, 80 Murwood Dr., Moreland Hills, Ohio 44022

[21] Appl. No.: 635,294

[22] Filed: Nov. 26, 1975

[51] Int. Cl.[2] ..... F15B 13/042; F15B 13/08

[52] U.S. Cl. ..... 137/596.13; 91/451

[58] Field of Search ..... 137/596.12, 596.13; 91/451, 468

[56] References Cited

U.S. PATENT DOCUMENTS

| | | | |
|---|---|---|---|
| Re. 26,028 | 5/1966 | Tennis | 137/596.13 X |
| 3,025,717 | 3/1962 | Christenson | 91/451 X |
| 3,225,781 | 12/1965 | Kruger et al. | 137/596.13 X |
| 3,416,561 | 12/1968 | Kokaly | 137/596.13 X |
| 3,470,694 | 10/1969 | Budzich | 60/427 |
| 3,488,953 | 1/1970 | Haussler | 60/462 |
| 3,605,806 | 9/1971 | Coatti | 137/596.13 |
| 3,878,864 | 4/1975 | Schurger | 137/596.13 |
| 3,882,896 | 5/1975 | Budzich | 137/596.1 |
| 3,977,301 | 8/1976 | Kroth et al. | 137/596.13 |
| 3,989,062 | 11/1976 | Tennis | 137/596.13 |

*Primary Examiner*—Irwin C. Cohen

*Attorney, Agent, or Firm*—William N. Hogg

[57] ABSTRACT

A pressure compensated load responsive flow control valve for use in a system controlling a plurality of loads. The system is powered by a single, fixed displacement pump. The flow control valve is equipped with a load responsive control, which during simultaneous control of multiple loads automatically maintains the pump discharge pressure at a level higher than the pressure required by the largest load being controlled. To obtain unidirectional flow, load sensing passages of individual valve spools are connected by check valves with the load responsive control, which is capable of fast response, without large control leakage from the load sensing circuit, in the direction to reduce fluid flow supplied to the system loads.

22 Claims, 2 Drawing Figures

14
W
63
64
52
49
12
55
67
17
22
70
69
68
13
W
39
40
28
25
11
31
43
17
21
48
46
45
44
132
133
138
130
134
136
131
148
126
107
127
137
129
128
135
139
147
125
114
143
121
144
141
120
122
20
140
123
124
119
115
113
109
112
108
19
142
117
111
116
118
110
16
145
146
15
FIXED DISPLACEMENT PUMP
17

LOAD RESPONSIVE CONTROL VALVE

BACKGROUND OF THE INVENTION

This invention relates generally to pressure compensated load responsive flow control valves of direction control type, which in control of a load, while using a control load pressure sensing passage, automatically maintain pump discharge pressure at a level higher, by a constant pressure differential, than the pressure required by the controlled load, by bypassing excess pump flow to system reservoir. Such a control valve disclosed in U.S. Pat. No. 3,488,953 dated Jan. 13, 1970, although effective in control of a single positive load at a time, cannot simultaneously control multiple positive loads. This disadvantage is overcome by control valve disclosed in my U.S. Pat. No. 3,882,896 and my pending patent application Ser. No. 522,324, filed Nov. 8, 1974, entitled "Load Responsive Fluid Control Valves", now U.S. Pat. No. 3,998,134, in which individual check valves, in load pressure sensing passages, permit phasing pressure signals of only the highest system load to the differential bypass control of the flow control valve, while isolating pressure signals from other loads. Those valves, although effective in control of multiple positive loads, suffer from a number of disadvantages. Because of the large cross sectional area of the differential bypass valve and its long control stroke, a comparatively large volume of fluid is required to operate it. Therefore small diameter and length of load pressure sensing passages, through which the fluid needed for displacement of the differential bypass valve must pass, limit the response of the valve control and tend to attenuate the control signal. The response of the differential bypass valve is also adversely affected by another factor. Since the displacement of fluid, caused by the movement of the differential bypass valve in one direction tends to close the check valves in control load sensing passages, isolating the control space filled with fluid, a constant path of leakage must be provided between the load sensing signal circuit and the system reservoir. This control leakage is usually obtained by providing an orifice between load sensing circuit and system reservoir. Since flow through the orifice is proportional to the square root of pressure differential, acting across it and since flow through the orifice determines response of the differential bypass valve in one direction, an acceptable response of control at low system pressure results in high leakage losses through the control orifice at high system pressure. This not only adversely affects the efficiency of the control valve, but also, since all of the increased leakage flow must be supplied through load pressure sensing passages, further attenuates the control signal.

SUMMARY OF THE INVENTION

It is therefore a principal object of this invention to provide control of a pressure compensated load responsive flow control valve, which provides the fast response of a differential bypass valve, while requiring minimum control flow from a load sensing circuit.

It is another object of this invention to reduce leakage flow from a load sensing circuit to a minimum, while retaining fast response of the differential bypass valve.

It is a further object of this invention to provide a control system of a pressure compensated load responsive flow control valve, which while retaining fast response of the differential bypass valve, will not largely attenuate the control signal transmitted through the load pressure sensing passages of the load sensing circuit.

Briefly the foregoing and other additional objects and advantages of this invention are accomplished by providing a novel, two stage pilot operated differential bypass valve. A pilot valve, responsive to pressure differential, existing between pump outlet pressure and load pressure, regulates the position of bypass valve, to maintain this pressure differential constant, while using for operation of the bypass valve energy from the fluid, supplied by the pump, instead of energy from fluid transmitted through the load pressure sensing passages of the load sensing circuit.

Similarly due to minimal cross sectional area and stroke of the differential pressure pilot valve, leakage from the load sensing circuit can be reduced to a minimum, while still retaining fast acting and accurate control, without significant attenuation of the load control signal.

Additional objects of the invention will become apparent when referring to the preferred embodiments of the invention as shown in the accompanying drawings and described in the following detailed description.

DESCRIPTION OF THE PREFERRED EMBODIMENTS

Figure 1:
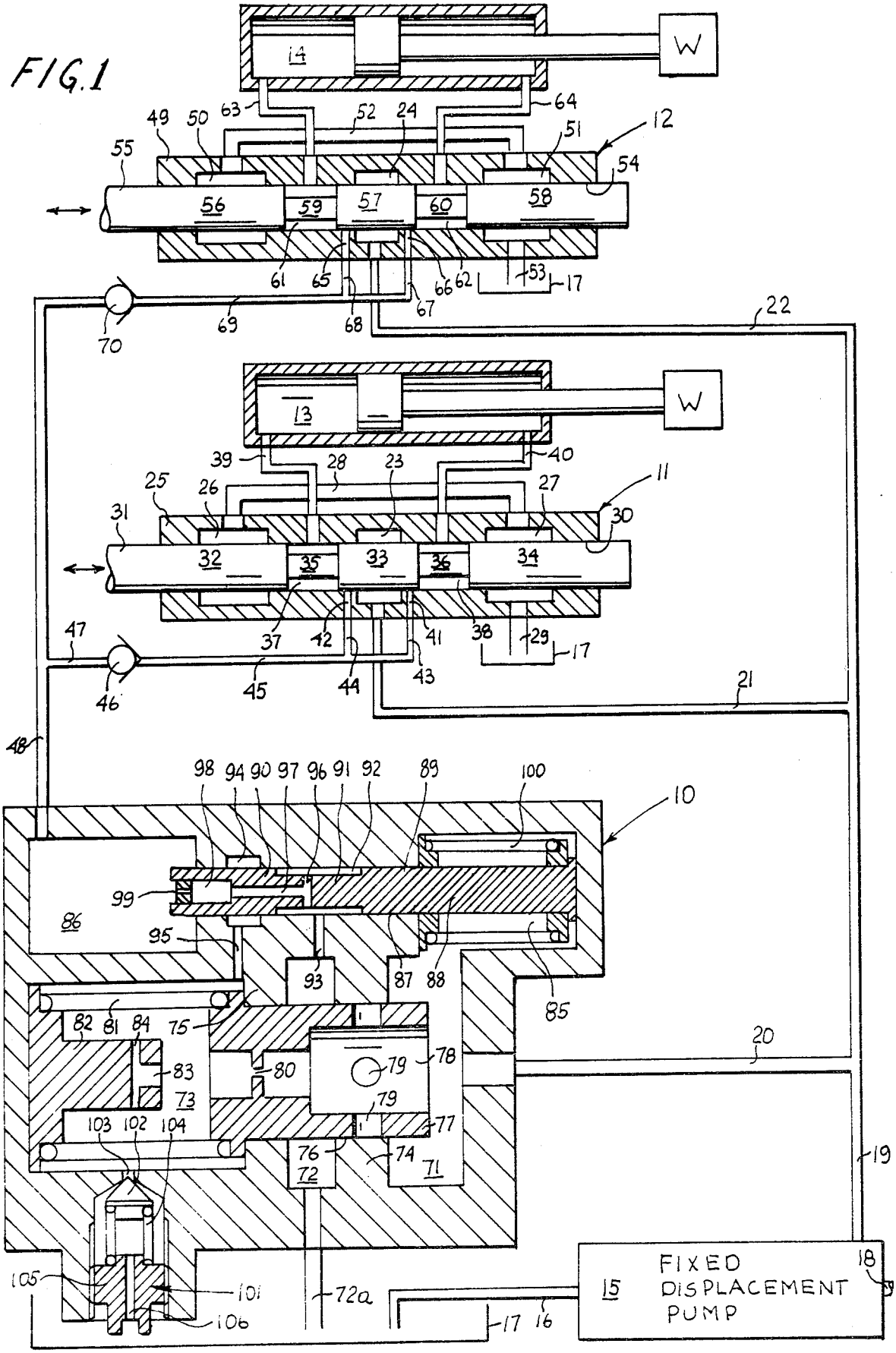
FIG. 1 is a longitudinal sectional view of an embodiment of a two stage pilot operated differential bypass valve used in control of flow from schematically shown direction control valve with system lines, pump and reservoir shown diagramatically.

Referring now to the drawings, FIG. 1 shows a section through a differential bypass valve assembly, generally designated as 10, connected into a circuit with direction control valve assemblies, generally designated as 11 and 12, controlling actuators 13 and 14 which drive loads W. Although in FIG. 1, for purposes of demonstration of the principle of the invention, differential bypass valve assembly 10 and direction control valve assemblies 11 and 12 are shown separated, in actual application they would be most likely contained in a single valve housing or would be bolted together as sections of a sectional valve assembly. As shown, fixed displacement pump 15 has an inlet line 16 which supplies fluid to pump from a reservoir 17 and the pump is driven through a shaft 18 by a prime mover not shown. The pump has an outlet line 19 which connects through line 20 to differential bypass valve assembly 10 and through lines 21 and 22 with inlet chambers 23 and 24 of direction control valve assemblies 11 and 12 respectively.

Direction control valve 11 has a valve housing 25 which defines inlet chamber 23 and also defines outlet chambers 26 and 27, which are connected to each other by a duct 28 and are further connected by a line 29 to reservoir 17. Valve housing 25 axially guides in a valve bore 30 a valve spool 31 which by lands 32, 33 and 34 and stems 35 and 36 defines load chambers 37 and 38, which are connected through lines 39 and 40 to actuator 13. Load sensing ports 41 and 42 are connected through lines 43, 44 and 45 to a check valve 46 which in turn is connected by lines 47 and 48 to differential bypass valve assembly 10.

Similarly direction control valve assembly 12 has a valve housing 49 which defines inlet chamber 24 and also defines outlet chambers 50 and 51, which are connected to each other by a duct 52 and further connected by a line 53 to reservoir 17. Valve housing 49 axially guides in a valve bore 54 a valve spool 55 which by lands 56, 57 and 58 and stems 59 and 60 defines load chambers 61 and 62, which are connected through lines 63 and 64 to actuator 14. Load pressure sensing ports 65 and 66 are connected through lines 67, 68 and 69 to a check valve 70, which in turn is connected by line 48 to differential bypass valve assembly 10.

The differential bypass valve assembly 10 has a supply chamber 71 communicating with pump 15, an exhaust chamber 72 communicating through a line 72*a* with reservoir 17 and a control chamber 73, those chambers being separated by partitions 74 and 75. A bore 76 passing through partitions 75 and 74 interconnects supply chamber 71, exhaust chamber 72 and control chamber 73 and axially guides a bypass member 77. Bypass member 77 has an inner bore 78 provided with extending circumferentially spaced ports 79 blocked, as shown in position in FIG. 1, by partition 74. Inner bore 78 communicates through a leakage orifice 80 in bypass member 77 with control chamber 73. A control spring 81, interposed between bypass member 77 and a stop 82, biases bypass member 77 towards position, as shown in FIG. 1. Stop 82 is provided with passages 83 and 84.

A portion of space 85 of supply chamber 71 is interconnected with a load pressure chamber 86 by a bore 87 axially guiding a differential pressure pilot valve 88. Differential pressure pilot valve 88 has lands 89 and 90 connected by a stem 91 defining an exhaust space 92 connected by a drilling 93 to exhaust chamber 72. A control space 94 in communication with bore 87 is connected by a drilling 95 with control chamber 73. Exhaust space 92 is connected through drillings 96, 97 and 98 and a leakage orifice 99, in differential pressure pilot valve 88, with load pressure chamber 86. A differential spring 100 in space 85 biases differential pressure pilot valve towards position as shown in FIG. 1.

Control chamber 73 is operationally connected by a high pressure pilot relief valve, generally designated as 101, with reservoir 17. High pressure pilot relief valve 101 has a poppet 102 biased into sealing engagement with a passage 103 by a relief valve spring 104, the preload of which is adjusted by a threaded insert 105, equipped with an exhaust flow passage 106.

All of the basic system components, as shown in FIG. 1, are at rest in unloaded or unactuated position, with fixed displacement pump 15 not working. With fixed displacement pump 15 started up, the pressure in outlet line 19, line 20 and supply chamber 71 will start to rise. Fluid pressure from supply chamber 71 will be transmitted through inner bore 78 and leakage orifice 80 to control space 73. Since momentarily the pressures in supply chamber 71 and control chamber 73 remain the same, the bypass member 77 will be maintained in place as shown, by control spring 81. The fluid pressure in supply chamber 71, transmitted to space 85, will react on the cross sectional area of differential pressure pilot valve 88, generating a force, which tends to move it from right to left, against the biasing force of differential spring 100. The load pressure chamber 86, during the initial stages of system start up is at atmospheric pressure, since it is connected through leakage orifice 99, drillings 98, 97, 96, space 92, drilling 93, exhaust chamber 72 and line 72*a* with the system reservoir 17.

As soon as pressure in supply chamber 71 and space 85 generates a sufficiently high force on cross sectional area of differential pressure pilot valve 88 to overcome the preload of differential spring 100, differential pilot valve 88 will move from right to left, trying to displace fluid from load pressure chamber 86. The resulting rise in pressure in load pressure chamber 86 will first close check valves 46 and 70, isolating load pressure chamber 86 from direction control valve assemblies 11 and 12. Rising pressure in load pressure chamber 86 will induce, in a well known manner, fluid flow through leakage orifice 99, permitting movement of differential pressure pilot valve 88 from right to left, the speed of the movement initially being proportional at rate of leakage through leakage orifice 99 and therefore being a function of pressure in load pressure chamber 86 and cross sectional area of differential pilot valve 88. The movement of differential pressure pilot valve 88, through displacement of land 90, will connect exhaust space 92 with control space 94, permitting a flow of fluid from pressurized control chamber 73 to reservoir 17 through drilling 95, control space 94, exhaust space 92, drilling 93, exhaust chamber 72 and drilling 72*a*. The pressurized fluid, lost in this way from control chamber 73, must be replenished from supply chamber 71, through leakage orifice 80. In a well known manner, pressure drop through leakage orifice 80 caused by the resulting fluid flow will maintain control chamber 73 at a lower pressure level than supply chamber 71, subjecting bypass member 77 to a force, tending to move it from right to left, against biasing force of control spring 81. Once the pressure drop through leakage orifice 80 creates a sufficiently large pressure differential between control chamber 73 and supply chamber 71 and generates a sufficiently large force, acting on bypass member 77, bypass member 77, will move from right to left, against biasing force of control spring 81. This movement will gradually connect through ports 79 of bypass member 77 and exhaust chamber 72, supply chamber 71 with reservoir 17. Under those conditions the fluid supplied by pump 15 to supply chamber 71 will be bypassed to exhaust chamber 72 and a condition of equilibrium will be established, under which sufficiently high pressure is maintained in supply chamber 71 to keep differential pressure pilot valve 88 displaced against biasing force of differential spring 100, and to induce sufficient flow from control space 73 to generate a sufficiently high pressure drop through leakage orifice 80, to provide sufficient force to maintain bypass member 77 in its bypass position. Therefore, under full bypass condition, pressure in the supply chamber 71 will be equal to the biasing force of differential spring 100 divided by the cross sectional are of differential pressure pilot valve 88. The cross sectional area of differential pressure pilot valve 88 is small and its movement from its neutral position to connect exhaust space 92 and control space 94 is also small, so that only a minimal displacement of fluid from the load pressure chamber 86 is required to bring differential pressure pilot valve 88 into its modulating position, resulting in a very fast response, even at very small leakage levels through leakage orifice 99. The biasing force of the differential spring 100 is so selected that the equilibrium condition of full bypass flow is obtained at low pressures, resulting in minimum system standby horsepower loss.

Assume that during the equilibrium bypass condition of differential bypass valve assembly 10, the valve spool 31 is initially displaced from left to right, displacement of land 33 connecting load chamber 37 with load sensing port 42. Assume also that load chamber 37 is subjected to pressure of positive load W, transmitted from actuator 13 through line 39. Load pressure from load sensing port 42, transmitted through lines 44 and 45, will open check valve 46 and pressurize load pressure chamber 86, while maintaining the check valve 70 closed. The rising pressure in load pressure chamber 86 will disrupt the equilibrium of forces, acting on differential pressure pilot valve 88, moving it from left to right and closing the passage between control space 94 and exhaust space 92. As a result, the pressure drop through leakage orifice 80 will be reduced, the only flow through leakage orifice 80 being that caused by resulting displacement from left to right of the bypass member 77, under action of biasing force of spring 81, which will gradually reduce the effective area of ports 79 and proportionally increase the pressure in supply chamber 71. The rising pressure in supply chamber 71 and space 85 will counteract the effect of rising pressure in load pressure chamber 86, until a point is reached, at which movement of the differential pressure pilot valve 88 from right to left will reestablish communication between control space 94 and exhaust space 92. This in turn, as previously described, will induce flow from control space 73, which in turn will position bypass member 77 in a new position, equivalent to the new condition of equilibrium, under which pressure in the supply chamber 71 will be maintained at a level, higher by a constant pressure differential, equal to the biasing force of the differential spring 100 divided by the cross sectional area of the differential pressure pilot valve 88, than the load pressure signal transmitted from the load W and actuator 13 to load pressure chamber 86. Under these conditions differential pressure pilot valve 88 will regulate the flow from control chamber 73 and resulting pressure differential between control chamber 73 and supply chamber 71, to regulate the position of the bypass member 77, to maintain the pressure in supply chamber 71 at a level, higher by a constant pressure differential, than the load pressure signal transmitted to the load pressure chamber 86.

Assume that valve spool 31 is further displaced from left to right connecting load chamber 37 and load sensing port 42 with inlet chamber 23 while at the same time connecting load chamber 38 with outlet chamber 27. As previously described inlet chamber 23 is maintained by pump 15 at a pressure, higher by a constant pressure differential, than pressure in load chamber 37. Fluid flow will take place from inlet chamber 23 to load chamber 37, this flow being proportional to the area of opening between those two chambers, since a constant pressure differential is maintained between them. Flow into actuator 13, of fluid supplied by the pump 15, will momentarily lower the pump discharge pressure and disturb the equilibrium of differential pressure valve assembly 10. As a result new bypass position of the bypass member 77 will be established and the differential pressure valve assembly 10 will revert to the condition of equilibrium, at which sufficient quantity of fluid from the pump 15 is bypassed to reservoir 17 by the bypass member 77, to maintain, in a manner as previously described, constant pressure differential between load chamber 37 and supply chamber 71. Any sudden rise in load W and corresponding increase in pressure in load chamber 37 and therefore load pressure chamber 86 will automatically reposition, in a manner as previously described, bypass member 77, to increase the pressure in supply chamber 71 and inlet chamber 23, to establish an equilibrium condition, at which a constant pressure differential is maintained between inlet chamber 23 and load chamber 37. Under these conditions, in a well known manner, flow supplied from the inlet chamber 23 to actuator 13 will be proportional to displacement of valve spool 31 from the position at which load chamber 37 and inlet chamber 23 become connected.

Displacement of valve spool 31 from right to left will at first connect load sensing port 41 through lines 43, 45, check valve 46 and line 48 to load pressure chamber 86. Further movement of valve spool 31 interconnects load chamber 38 with inlet chamber 23 and also interconnects load chamber 37 with outlet chamber 26. The response of the control and the sequence of operations will be the same as those resulting from the displacement of the valve spool 31 in the opposite direction which has already been described in detail.

Assume that valve spools 31 and 55 are simultaneously displaced from left to right, connecting load sensing ports 42 and 65 with load chambers 37 and 61. Assume also that pressure of positive load exists in both load chambers and that load chamber 61 is subjected to higher pressure than load chamber 37. The higher pressure signal from load chamber 61 will be transmitted through load pressure sensing port 65, lines 68 and 69, check valve 70 and line 48 to load pressure chamber 86. The higher load pressure signal from line 48 will also be transmitted by line 47 to check valve 46, in a well known manner maintaining it closed and therefore isolating load sensing port 42 from load pressure chamber 86.

The response of the system control to high pressure signal in load pressure chamber 86 has already been described in detail. However, if resulting pressure in control chamber 73, due to the system load demand will exceed a level equal to the preload in the relief valve spring 104 divided by the cross sectional area of passage 103, the high pressure pilot relief valve 101 will open and in a well known manner bypass flow from control chamber 73 to reservoir 17. In a manner, as previously described when referring to flow from control chamber 73 through bypass created by differential pressure pilot valve 88, the resistance to flow through orifice 80 will create an unbalance of forces acting on the bypass member 77, moving it from right to left and reducing the system pressure to the level, equivalent to the setting of the high pressure pilot relief valve 101. Under those conditions the high load pressure, existing in load pressure chamber 86, will maintain the differential pressure pilot valve 88 in its fully closed position, the system pressure being maintained at a constant value by high pressure pilot relief valve 101, the characteristics of the flow control valve, of maintaining constant pressure differential between pump and load pressures, being momentarily lost. With drop in load pressure below the setting of the high pressure pilot relief valve, the valve control will assume it normal mode of operation. Since during simultaneous operation of two loads, the control system will maintain a constant pressure differential between the pump pressure and the pressure of the highest of the system loads, the flow control feature of the lower loads will be lost.

Figure 2:
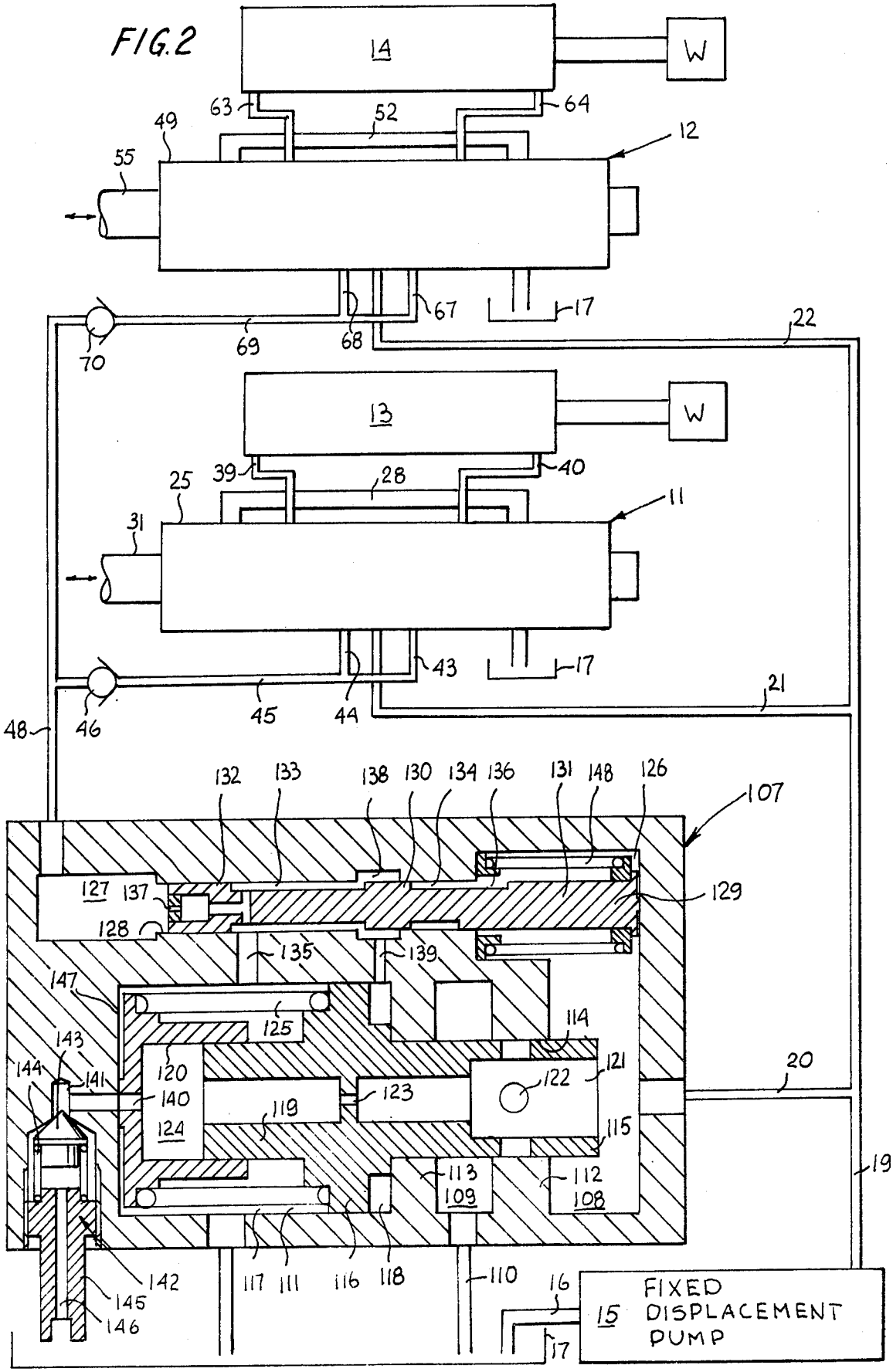
FIG. 2 is a longitudinal sectional view of another embodiment of a two stage pilot operated differential bypass valve used in control of flow from schematically shown direction control valve with system lines, pump and reservoir shown diagramatically.

Referring now to FIG. 2, an identical arrangement of direction control valve assemblies 11 and 12 are connected to fixed displacement pump 15 and are phased by check valves 46 and 70 to another embodiment of a differential bypass valve assembly, generally designated as 107. The differential bypass valve assembly 107 has a supply chamber 108 communicating with pump 15 through line 20, an exhaust chamber 109 communicating through a line 110 with reservoir 17 and a chamber 111, these chambers being separated by partitions 112 and 113. A bore 114 passing through partitions 112 and 113 interconnects supply chamber 108, exhaust chamber 109 and chamber 111 and axially guides a bypass member 115. Bypass member 115 has a piston 116, dividing chamber 111 into a low pressure zone 117 and a control pressure zone 118. Bypass member 115 has also an extension 119 at one end slidably guiding a reaction cylinder 120 and an inner bore 121 at the other end provided with radially extending circumferentially spaced ports 122 blocked in the position as shown in FIG. 2 by partition 112. Inner bore 121 communicates through a leakage orifice 123 with a space 124 in reaction cylinder 120. A control spring 125 is interposed between reaction cylinder 120 and piston 116, maintaining bypass member 115 in position as shown in FIG. 2.

A portion of space 126 of supply chamber 108, is interconnected with a load pressure chamber 127 by a bore 128, axially guiding a differential pressure pilot valve 129. Differential pressure pilot valve 129 has lands 130, 131 and 132 defining an exhaust space 133 and a high pressure space 134. Exhaust space 133 is connected by a drilling 135 to low pressure zone 117, communicating with reservoir 17 and also communicates through a leakage orifice 137 with load pressure chamber 127. High pressure space 134 communicates through a groove 136 in differential pressure pilot valve 129 with space 126. A control space 138 is connected through a drilling 139 with control pressure zone 118. Space 124 in reaction cylinder 120 is connected through a drilling 140 with a port 141, sealed by a high pressure pilot relief valve, generally designated as 142, which has a poppet 143, a spring 144 and a threaded body 145, equipped with a passage 146. Reaction cylinder 120 is maintained in sealing engagement with a face 147 by preload in control spring 125 and by the pressure in space 124.

All of the basic system components, as shown in FIG. 2, are at rest in unloaded or unactuated position, with fixed displacement pump 15 not working. When the fixed displacement pump 15 is started up, the pressure in outlet line 19, line 20 and supply chamber 108 will start to rise. Fluid pressure from supply chamber 108 will be transmitted through inner bore 121 and leakage orifice 123 to space 124 in reaction cylinder 120. The cross sectional areas of extension 119 and front end of bypass member 115, containing radially spaced port 122, are made the same so that the reaction forces, developed by pressure in the space 124 and supply chamber 108 on bypass member 115, tend to oppose and cancel each other. The fluid pressure in supply chamber 108 supplied to space 126 will react on the cross sectional area of differential pressure pilot valve 129, generating a force, which would tend to move it from right to left against biasing force of a differential spring 148. Since load pressure chamber 127 is connected to system reservoir 17 through leakage orifice 137, exhaust space 133, drilling 135 and low pressure zone 117, it is initially maintained at atmospheric pressure. As soon as pressure in supply chamber 108 and space 126 generates a sufficiently high force on cross sectional area of differential pressure pilot valve 129 to overcome the preload of differential spring 148, the differential pilot valve 129 will move from right to left, trying to displace fluid from load pressure chamber 127. The resulting rise in pressure in load pressure chamber 127 will first close check valves 46 and 70, isolating load pressure chamber 127 from directional control valve assemblies 11 and 12. Rising pressure in load pressure chamber 127 will induce, in a well known manner, fluid flow through leakage orifice 137, permitting movement of differential pressure pilot valve 129 from right to left, the speed of movement being proportional to rate of leakage through leakage orifice 137 and therefore being a function of pressure in load pressure chamber 127 and cross sectional area of differential pressure pilot valve 129. The movement of differential pressure pilot valve 129 through displacement of land 130 will first close communication between control space 138 and exhaust space 133 and then open control space 138 to high pressure space 134. The rising pressure in control space 138 will be transmitted through drilling 139 to control pressure zone 118 and will react on the effective cross sectional area of piston 116, compressing control spring 125 and moving the bypass member 115 from right to left, until ports 122 cross connect supply chamber 108 with exhaust chamber 109, bypassing flow from pump 15 to reservoir 17. The differential pressure pilot valve 129 will modulate, maintaining bypass member 115 in a bypass position, which in turn will maintain the pressure in supply chamber 108 at a level, equal to the preload of the differential spring 148 divided by the cross sectional area of differential pressure pilot valve 129. An increase in pressure in load pressure chamber 127 will move the differential pressure pilot valve 129 from left to right, connecting control space 138 with exhaust space 133. With a drop in pressure in control pressure zone 118 under the action of the control spring 125, the bypass member 115 will move from left to right, decreasing the amount of bypass flow. As a result the pressure in the supply chamber 108 will start to rise, until it will overcome the combined force of the differential spring 148 and force generated by the pressure in load pressure chamber 127, acting on cross sectional area of differential pressure pilot valve 129, moving it back to its modulating position. Therefore differential pressure pilot valve 129 will always control the position of the bypass member 115 to maintain a constant pressure differential between supply chamber 108 and load pressure chamber 127, this pressure differential being equal to the preload of the differential spring 148 divided by the cross sectional area of the differential pressure pilot valve 129. If the pressure in supply chamber 108 and space 124 rises to a level, at which it overcomes the preload of spring 144 of the high pressure pilot relief valve 142 a flow of fluid is induced from the space 124 to reservoir 17. This flow of fluid from space 124 is supplied through leakage orifice 123 from supply chamber 108 and creates a pressure drop through leakage orifice 123 which in turn, in a well known manner, unbalances the forces acting on bypass member 115, moving it from right to left to a position where sufficient fluid from the supply chamber 108 is bypassed to exhaust chamber 109 to maintain the discharge pressure of pump 15 at the pressure setting of the high pressure relief valve 142. While the system pressure is maintained by the high pressure pilot relief valve 142, the differential pressure pilot valve 129 is maintained by high pressure in load pressure chamber 127 in the position as shown in FIG. 2, with control space 138 connected to exhaust space 133. With the drop in pressure in the load pressure chamber 127, high pressure pilot relief valve 142 closes and the differential pressure pilot valve 129 reverts to its modulating position, maintaining, as previously described, a constant pressure differential between supply chamber 108 and load pressure chamber 127.

Actuation of direction control valve assemblies 11 and 12, in a manner as previously described when referring to FIG. 1, will transmit through check valves 46 and 70 the highest positive load system pressure to the load pressure chamber 127. The differential bypass valve assembly 107 will respond, in a manner as already described above, always maintaining a constant pressure differential between supply chamber 108 and load pressure chamber 127.

The basic operation of the differential bypass valve assembly 10 of FIG. 1 and 107 of FIG. 2 is the same, since both of the maintain a constant pressure differential between their respective supply chambers and load pressure chambers. Furthermore both of those valves maintain this constant pressure differential by regulating, through change in position of a bypass member, the amount of fluid bypassed from supply chamber to system reservoir. Both of those valves provide high response with only minimal leakage from load pressure chambers and both of those valves use energy of the pump in moving bypass members. Those valves differ only in the way the respective differential pressure pilot valves control the position of the bypass members. In differential bypass valve assembly 10 the differential pressure pilot valve 88 regulates the control flow from control chamber 73 and by subjecting bypass member 77 to unbalanced force condition, regulates its position. In differential bypass valve assembly 107 differential pressure pilot valve 129 regulates the pressure in control pressure zone 118, therefore controlling the position of the bypass member 115 and the quantity of bypass flow of fluid between supply chamber 108 and system reservoir.

Through the use of two stage differential bypass valve assemblies 10 and 107 and specifically through the use of differential pressure pilot valves 88 and 129 very fast response of the control can be obtained, both while increasing and decreasing the bypass flow of the control, in response to the load pressure signal. While increasing the bypass flow, because of its extremely small control stroke and small cross sectional area, the response of the differential pressure pilot valve, even with minimum leakage through leakage orifices 99 and 137 is very fast. On the other hand when decreasing the bypass flow, the flows through the load sensing circuits, resulting from the displacement of the differential pressure pilot valve through its control stroke are so small that the attenuation of the load pressure signal in the control lines is minimal. At the same time the response of the bypass members 77 and 115 to the control signal of the differential pressure pilot valves 88 and 129 is very fast, since energy derived from pump circuit is utilized to displace comparatively large bypass member 77 and 115.

Although preferred embodiments of this invention have been shown and described in detail it is recognized that the invention is not limited to the precise forms and structure shown and various modifications and rearrangements as will readily occur to those skilled in the art upon full comprehension of this invention may be resorted to without departing from the scope of the invention as defined in the claims.

What is claimed is:

1. A valve assembly comprising at least one housing having an inlet chamber, a load chamber, an outlet chamber and exhaust means, valve bore means defining an opening in said housing interconnecting said chambers and axially guiding a valve spool, load sensing port means at the region of said valve bore means between said inlet chamber and said load chamber, leakage means interconnecting said load sensing port means and said exhaust means, bypass valve means interconnecting said inlet chamber and said exhaust means, said bypass valve means having flow regulating means to vary bypass flow from said inlet chamber to said exhaust means, said flow regulating means having actuating means operable responsive to control signal transmitted from pilot valve means, said pilot valve means interposed between said inlet chamber and said load sensing port means and having control signal generating means and control signal modulating means, said pilot valve means being in direct communication with said inlet chamber, said control signal modulating means having means responsive to pressure differential between said inlet chamber and said load sensing port means, said pilot valve means operable to control through said actuating means of said flow regulating means bypass flow of said bypass valve means to maintain a constant pressure differential between said inlet chamber and said load chamber under all conditions of operation when said inlet chamber is interconnected to said load chamber by said valve spool and said load chamber is pressurized.

2. A valve assembly as set forth in claim 1 wherein said valve spool axially guided in said valve bore means has a neutral position in which it blocks said load sensing port means and isolates said load chamber from said inlet chamber and said outlet chamber, said valve spool being movable from said neutral position to at least one actuated position, said valve spool when displaced from said neutral position towards each actuated position first connecting said load chamber to said load sensing port means and then interconnecting said load chamber with said inlet chamber.

3. A valve assembly as set forth in claim 1 wherein said bypass valve means has a bypass spool, said bypass spool having means responsive to pressure drop due to fluid flow across an orifice means and operable to actuate said bypass spool and said pilot valve means has means controlling flow through said orifice means to operate said bypass spool and regulate bypass flow between said inlet chamber and said exhaust means.

4. A valve assembly as set forth in claim 1 wherein said bypass valve means has a bypass spool having pressure responsive force generating means operable to actuate said bypass spool and said pilot valve means has means to control pressure of said pressure responsive force generating means to actuate said bypass spool to regulate bypass flow between said inlet chamber and said exhaust means.

5. A valve assembly comprising a multiplicity of housings each housing having an inlet chamber, a load chamber subjected to load pressure, an outlet chamber and exhaust means, valve bore means in each housing interconnecting said chambers and axially guiding a valve spool, load sensing port means selectively communicable with said load chamber by said valve spool, check valve means operable connected with each of said load sensing port means to permit flow from said load sensing port means to a control pressure zone and to block reverse flow from said control pressure zone, leakage means interconnecting said control pressure zone and said exhaust means, bypass valve means interconnecting said inlet chambers and said exhaust means of each of said housings, said bypass valve means having flow regulating means to vary bypass flow from said inlet chambers to said exhaust means, said flow regulating means having actuating means operable responsive to control signal transmitted from pilot valve means, said pilot valve means interposed between said inlet chambers and said control pressure zone and having control signal generating means and control signal modulating means said pilot valve means being in direct communication with said inlet chamber, said control signal modulating means having means responsive to pressure differential between pressure in said inlet chambers and pressure in said control pressure zone connected by said check valve means to load chamber subjected to highest load pressure, said pilot valve means operable to control through said actuating means of said flow regulating means bypass flow of said bypass valve means to maintain a constant pressure differential between said inlet chambers and said load chamber subjected to highest load pressure under all conditions of operation when one of said inlet chambers is interconnected to said load chamber subjected to highest load pressure by said valve spool.

6. A valve assembly as set forth in claim 5 wherein said bypass valve means has a bypass spool, said bypass spool having means responsive to pressure drop due to fluid flow across an orifice means and operable to actuate said bypass spool and said pilot valve means has means controlling flow through said orifice means to operate said bypass spool and regulate bypass flow between said inlet chambers and said exhaust means.

7. A valve assembly as set forth in claim 5 wherein said bypass valve means has a bypass spool having pressure responsive force generating means operable to actuate said bypass spool and said pilot valve means has means to control pressure of said pressure responsive force generating means to actuate said bypass spool to regulate bypass flow between said inlet chambers and said exhaust means.

8. A valve assembly comprising at least one housing having an inlet chamber, a load chamber, an outlet chamber and exhaust means, valve bore means in said housing interconnecting said chambers and axially guiding a valve spool, load sensing port means at the region of said valve bore means between said inlet chamber and said load chamber, leakage means interconnecting said load sensing port means and said exhaust means, bypass valve means interconnecting said inlet chamber and said exhaust means and operable responsive to pilot valve means to bypass fluid from said inlet chamber to said exhaust means, said bypass valve including a bypass spool, spring biasing means to bias said bypass spool in one direction to reduce said bypass flow, pressure responsive force generating means to bias said bypass spool in opposite direction to increase said bypass flow, said pilot valve means interposed between said inlet chamber and said load sensing port means said pilot valve means being in direct communication with said inlet chamber, said pilot valve means having means responsive to pressure differential between said inlet chamber and said load sensing port means, said pilot valve means including control signal generating means to activate said pressure responsive force generating means of said bypass valve means and operable to control said bypass flow between said inlet chamber and said exhaust means to maintain pressure differential between said inlet chamber and said load chamber under all conditions of operation at a constant preselected value when said inlet chamber and said load chamber are interconnected and when said load chamber is pressurized.

9. A valve assembly as set forth in claim 8 wherein said pressure responsive force generating means has means responsive to pressure drop due to fluid flow across an orifice means and said control signal generating means has means controlling flow through said orifice means to operate said bypass spool and regulate bypass flow between said inlet chamber and said exhaust means.

10. A valve assembly as set forth in claim 8 wherein said pressure responsive force generating means has means responsive to control pressure signal and said control signal generating means has means to vary pressure of said control pressure signal to operate said bypass spool and regulate bypass flow between said inlet chamber and said exhaust means.

11. A valve assembly as set forth in claim 8 wherein said pilot valve means has a pilot valve spool, spring biasing means to bias said pilot valve spool in one direction to reduce control signal of said control signal generating means transmitted to said pressure responsive force generating means and means responsive to pressure differential between said inlet chamber and said load sensing port means to bias said pilot valve spool in opposite direction to increase control signal of said control signal generating means transmitted to said pressure responsive force generating means.

12. A valve assembly as set forth in claim 8 wherein said bypass spool means includes means providing a pressure compartment at the region of the end of said bypass spool in communication with said pilot valve means and pressure relief valve means operably connecting said pressure compartment with said exhaust means.

13. A valve assembly comprising a multiplicity of housings each housing having an inlet chamber, a load chamber subjected to load pressure, an outlet chamber and exhaust means, valve bore means in each housing interconnecting said chambers and axially guiding a valve spool, load sensing port means at the region of each valve bore means between said inlet chamber and said load chamber, check valve means operably connected with each of said load sensing port means to permit flow from said load sensing port means to a control pressure zone and to block reverse flow from said control pressure zone, leakage means interconnecting said control pressure zone and said exhaust means, bypass valve means interconnecting said inlet chambers and said exhaust means of each of said housings and operable responsive to pilot valve means to bypass flow from said inlet chambers to said exhaust means, said bypass valve means including a bypass spool, spring biasing means to bias said bypass spool in one direction to reduce said bypass flow, pressure responsive force generating means to bias said bypass spool in opposite direction to increase said bypass flow, said pilot valve means interposed between said inlet chambers and said control pressure zone, said pilot valve means being in direct communication with said inlet chamber, said pilot valve means having means responsive to pressure differential between pressure in said inlet chambers and pressure in said control pressure zone connected by said check valve means to load chamber subjected to highest load pressure, said pilot valve means including control signal generating means to activate said pressure responsive force generating means and operable to control said bypass flow of said bypass valve means to maintain a constant pressure differential between said inlet chambers and said load chamber under all condition of operation subjected to highest load pressure when one of said inlet chambers is interconnected to said load chamber subjected to highest load pressure by said valve spool.

14. A valve assembly as set forth in claim 13 wherein said pressure responsive force generating means has means responsive to control pressure signal and said control signal generating means has means to vary pressure of said control pressure signal to operate said bypass spool and regulate bypass flow between said inlet chambers and said exhaust means.

15. A valve assembly as set forth in claim 13 wherein said pressure responsive force generating means has means responsive to pressure drop due to fluid flow across an orifice means and said control signal generating means has means controlling flow through said orifice means to operate said bypass spool and regulate bypass flow between said inlet chambers and said exhaust means.

16. A valve assembly as set forth in claim 13 wherein said pilot valve means has a pilot valve spool, spring biasing means to bias said pilot valve spool in one direction to reduce control signal of said control signal generating means transmitted to said pressure responsive force generating means and means responsive to pressure differential between said inlet chambers and said load sensing port means of load chamber subjected to highest load to bias said pilot valve spool in opposite direction to increase control signal of said control signal generating means transmitted to said pressure responsive force generating means.

17. A valve assembly as set forth in claim 13 wherein said bypass spool means includes means providing a pressure compartment at the region of the end of said bypass spool in communication with said pilot valve means, pressure relief valve means operable connecting said pressure compartment with said exhaust means.

18. A fourway fluid control valve assembly comprising at least one housing having an inlet chamber, first and second load chambers an outlet chamber and exhaust means a valve bore in direct communication with said aforementioned chambers, said valve bore axially guiding a valve spool having lands, said valve spool having a neutral position in which said lands isolate said chambers, bypass valve means interconnecting said inlet chamber and said exhaust means and operable responsive to pilot valve means to bypass fluid flow from said inlet chamber to said exhaust means said bypass valve means including a bypass spool, spring biasing means to bias said bypass spool in direction to decrease bypass flow, pressure responsive force generating means to bias said bypass spool in direction to increase said bypass flow, a pilot valve means responsive to pressure differential between said inlet chamber and either of said load chambers which is pressurized and connected to said inlet chamber, operable to vary pressure of said pressure responsive force generating means to maintain said pressure differential at a constant level, said pilot valve means being in direct communication with said inlet chamber, said pilot valve means including a pilot valve spool guided in a pilot valve bore, said pilot valve spool having pressure regulating means, spring biasing means to bias said pilot valve spool in direction to decrease pressure of said pressure regulating means, means responsive to pressure differential between said inlet chamber and said load sensing port to bias said pilot valve spool in direction to increase pressure of said pressure regulating means, first pressure signal passage interconnecting one region of said valve bore between said inlet chamber and said first load chamber and said pilot valve means, second pressure signal passage interconnecting another region of said valve bore between said inlet chamber and said second load chamber and said pilot valve means, leakage orifice means interconnecting said first and second pressure signal passage with said exhaust means, said first and second pressure signal passages being blocked by said valve spool in its neutral position, said valve spool when displaced from its neutral position in one direction first interconnecting said first load chamber with said first pressure signal passage to said pilot valve means and then interconnecting said first load chamber with said inlet chamber, said valve spool when displaced from its neutral position in opposite direction first interconnecting said second pressure signal passage to said pilot valve means and then interconnecting said second load chamber with said inlet chamber whereby said pilot valve means will control said bypass valve means under all conditions of operation to maintain a constant pressure differential between said inlet chamber and one of said load chambers which is pressurized and interconnected to said inlet chamber.

19. A fourway fluid control valve assembly comprising at least one housing having an inlet chamber, first and second load chambers, an outlet chamber and exhaust means, a valve bore in direct communication with said aforementioned chambers, said valve bore axially guiding a valve spool having lands, said valve spool having a neutral position in which said lands isolate said chambers, bypass valve means interconnecting said inlet chamber and said exhaust means and operable responsive to pilot valve means to bypass fluid flow from said inlet chamber to said exhaust means said bypass valve means including a bypass spool, spring biasing means to bias said bypass spool in direction to decrease bypass flow, means responsive to pressure drop due to fluid flow across an orifice means to bias said bypass spool in direction to increase said bypass flow, a pilot valve means responsive to pressure differential between said inlet chamber and either of said load chambers which is pressurized and connected to said inlet chamber, said pilot valve means being in direct communication with said inlet chamber, operable to vary flow through said means responsive to pressure drop due to fluid flow across said orifice means to maintain said pressure differential at a constant level, said pilot valve means including a pilot valve spool guided in a pilot valve bore, said pilot valve spool having orifice flow regulating means, spring biasing means to bias said pilot valve spool in direction to decrease flow through said orifice means, means responsive to pressure differential between said inlet chamber and said load sensing port to bias said pilot valve spool in direction to increase flow through said orifice means, first pressure signal passage interconnecting one region of said valve bore between said inlet chamber and said first load chamber and said pilot valve means, second pressure signal passage interconnecting another region of said valve bore between said inlet chamber and said second load chamber and said pilot valve means, leakage orifice means interconnecting said first and second pressure signal passage with said exhaust means, said first and second pressure signal passages being blocked by said valve spool in its neutral position, said valve spool when displaced from its neutral position in one direction first interconnecting said first load chamber with said first pressure signal passage to said pilot valve means and then interconnecting said first load chamber with said inlet chamber, said valve spool when displaced from its neutral position in opposite direction first interconnecting said second pressure signal passage to said pilot valve means and then interconnecting said second load chamber with said inlet chamber whereby said pilot valve means will control said bypass valve means under all conditions of operation to maintain a constant pressure differential between said inlet chamber and one of said load chambers which is pressurized and interconnected to said inlet chamber.

20. A fourway fluid control valve assembly comprising a multiplicity of housings, each housing having an inlet chamber, first and second load chambers subjected to load pressure, an outlet chamber and exhaust means, a valve bore in each housing in direct communication with said aforementioned chambers, each valve bore axially guiding a valve spool having lands, said valve spool having a neutral position in which said lands isolate said chambers, bypass valve means interconnecting said inlet chambers and said exhaust means and operable responsive to pilot valve means to bypass fluid flow from said inlet chambers to said exhaust means said bypass valve means including a bypass spool, spring biasing means to bias said bypass spool in direction to decrease bypass flow, pressure responsive force generating means to bias said bypass spool in direction to increase said bypass flow, pilot valve means responsive to pressure differential between said inlet chambers and pressure in load chamber subjected to highest load pressure, operable to vary pressure responsive force generating means to maintain said pressure differential at a constant level, said pilot valve means being in direct communication with said inlet chamber, said pilot valve means including a pilot valve spool guided in a pilot valve bore, said pilot valve spool having pressure regulating means, spring biasing means to bias said pilot valve spool in direction to decrease pressure of said pressure regulating means, means responsive to pressure differential between said inlet chambers and pressure in load chamber subjected to highest load pressure to bias said pilot valve spool in direction to increase pressure of said pressure regulating means, first pressure signal passage interconnecting one region of each of said valve bores between said inlet chamber and said first load chamber and said pilot valve means, first check valve means in said passage permitting flow through said passage to said pilot valve means and blocking reverse flow, second pressure signal passage interconnecting another region of each of said valve bores between said inlet chamber and said second load chamber and said pilot valve means, second check valve means in said second passage permitting flow through said passage to said pilot valve means and blocking reverse flow, leakage orifice means interconnecting all of said pressure signal passages between said check valve means and said pilot valve means to said exhaust means, said first and second pressure signal passages in each valve housing being blocked by said valve spool in its neutral position, said valve spool when displaced from its neutral position in one direction first interconnecting said first load chamber with said first pressure signal passage containing said first check valve means to said pilot valve means and then interconnecting said first load chamber with said inlet chambers, said valve spool when displaced from its neutral position in opposite direction first interconnecting said second pressure signal passage through said second check valve means to said pilot valve means and then interconnecting said second load chamber with said inlet chamber whereby said pilot valve means will control said bypass valve means to maintain a constant pressure differential between said inlet chambers and one of said load chambers subjected to highest load pressure under all conditions of operation when one of said inlet chambers is interconnected to said load chamber subjected to highest load pressure by said valve spool.

21. A fourway fluid control valve assembly comprising a multiplicity of housings, each housing having an inlet chamber first and second load chambers subjected to load pressure, an outlet chamber and exhaust means, a valve bore in each housing in direct communication with said aforementioned chambers, each valve bore axially guiding a valve spool having lands, said valve spool having a neutral position in which said lands isolate said chambers, bypass valve means interconnecting said inlet chambers and said exhaust means and operable responsive to pilot valve means to bypass fluid flow from said inlet chambers to said exhaust means said bypass valve means including a bypass spool, spring biasing means to bias said bypass spool in direction to decrease bypass flow, means responsive to pressure drop due to fluid flow across an orifice means to bias said bypass spool in direction to increase said bypass flow, pilot valve means responsive to pressure differential between said inlet chambers and pressure in load chamber subjected to highest load pressure, operable to vary flow through said means responsive to pressure drop due to fluid flow across said orifice means to maintain said pressure differential at a constant level, said pilot valve means being in direct communication with said inlet chamber said pilot valve means including a pilot valve spool guided in a pilot valve bore, said pilot valve spool having orifice flow regulating means, spring biasing means to bias said pilot valve spool in direction to decrease flow through said orifice means, means responsive to pressure differential between said inlet chambers and pressure in load chamber subjected to highest load pressure to bias said pilot valve spool in direction to increase flow through said orifice means, first pressure signal passage interconnecting one region of each of said valve bores between said inlet chamber and said first load chamber and said pilot valve means, first check valve means in said passage permitting flow through said passage to said pilot valve means and blocking reverse flow, second pressure signal passage interconnecting another region of each of said valve bores between said inlet chamber and said second load chamber and said pilot valve means, second check valve means in said second passage permitting flow through said passage to said pilot valve means and blocking reverse flow, leakage orifice means interconnecting all of said pressure signal passages between said check valve means and said pilot valve means to said exhaust means, said first and second pressure signal passages in each valve housing being blocked by said valve spool in its neutral position, said valve spool when displaced from its neutral position in one direction first interconnecting said first load chamber with said first pressure signal passage containing said first check valve means to said pilot valve means and then interconnecting said first load chamber with said inlet chambers, said valve spool when displaced from its neutral position in opposite direction first interconnecting said second pressure signal passage through said second check valve means to said pilot valve means and then interconnecting said second load chamber with said inlet chamber whereby said pilot valve means will control said bypass valve means to maintain a constant pressure differential between said inlet chambers and one of said load chambers subjected to highest load pressure under all conditions of operation when one of said inlet chambers is interconnected to said load chamber subjected to highest load pressure by said valve spool.

22. A valve assembly comprising at least one housing having an inlet chamber, a load chamber, an outlet chamber and exhaust means, valve bore means defining an opening in said housing interconnecting said chambers and axially guiding a valve spool, load sensing port means selectively communicable with said load chamber by said valve spool, leakage means interconnecting said load sensing port means and said exhaust means, bypass valve means interconnecting said inlet chamber and said exhaust means, said bypass valve means having flow regulating means to vary bypass flow from said inlet chamber to said exhaust means, said flow regulating means having actuating means operable responsive to control signal transmitted from pilot valve means, said pilot valve means interposed between said inlet chamber and said load sensing port means and having control signal generating means and control signal modulating means, said pilot valve means being in direct communication with said inlet chamber, said control signal modulating means having means responsive to pressure differential between said inlet chamber and said load sensing port means, said pilot valve means operable to control through said actuating means of said flow regulating means bypass flow of said bypass valve means to maintain a constant pressure differential between said inlet chamber and said load chamber under all conditions of operation when said inlet chamber is interconnected to said load chamber by said valve spool and said load chamber is pressurized.

* * * * *